US006131703A

United States Patent [19]

Gates

[11] Patent Number: 6,131,703

[45] Date of Patent: Oct. 17, 2000

[54] SAFETY DEVICE FOR A CABLE HOIST

[75] Inventor: Frank V. Gates, Succasunna, N.J.

[73] Assignee: Lucent Technologies Inc., Murray Hill, N.J.

[21] Appl. No.: 09/198,103

[22] Filed: Nov. 12, 1998

[51] Int. Cl.[7] ..... B66B 5/12

[52] U.S. Cl. ..... 187/363; 187/361; 187/351

[58] Field of Search ..... 187/351, 352, 187/361–366, 359

[56] References Cited

U.S. PATENT DOCUMENTS

| | | | |
|---|---|---|---|
| 285,309 | 9/1883 | Salom | 187/363 |
| 286,760 | 10/1883 | Bachmann | 187/363 X |
| 366,745 | 7/1887 | Taylor et al. | 187/363 |
| 375,203 | 12/1887 | Schuller | 187/363 X |
| 870,084 | 11/1907 | Coleman | 187/363 |
| 1,057,303 | 3/1913 | Trepa | 187/363 |
| 1,061,103 | 5/1913 | Moskal | 187/363 |
| 2,039,606 | 5/1936 | Porcelli | 187/363 |
| 2,403,333 | 7/1946 | Bjerke | 187/363 |

FOREIGN PATENT DOCUMENTS

| | | | |
|---|---|---|---|
| 341846 | 8/1904 | France | 187/363 |
| 1736890 A1 | 5/1992 | U.S.S.R. | 187/351 |
| 212125 | 8/1904 | United Kingdom | 187/361 |

*Primary Examiner*—Robert P. Olszewski
*Assistant Examiner*—Thuy V. Tran
*Attorney, Agent, or Firm*—David L. Davis

[57] ABSTRACT

A safety device for a platform cable hoist within a lattice-work tower including a plurality of skid members which are flexed inwardly when there is tension from a lift cable. Brake members are secured to the skid members and, in the event the cable fails, the skid members deflect outwardly so that the brake members, which have hook portions at their upper ends, engage transverse braces of the tower. Between the hook portions and the skid members, the brake members are formed with an energy absorbing portion which absorbs kinetic energy from the falling platform to slow and stop its descent.

8 Claims, 5 Drawing Sheets

SAFETY DEVICE FOR A CABLE HOIST

BACKGROUND OF THE INVENTION

This invention relates to a cable hoist for a platform contained within a latticework tower and, more particularly, to a safety device for such a hoist which is effective to stop the free fall of the platform in the event of a cable break or other failure.

Cellular telephone base stations typically have an electronics assembly mounted where it is readily accessible to a technician and one or more antennas mounted on an elevated structure to increase the line-of-sight range of the base station. Recently, there has been developed a smaller cell site, called a microcell, to cover "hot spots" and "dead spots". The microcell has less power and provides fewer channels than a "normal" cell site and was designed for a smaller coverage area. However, for some applications it would be advantageous to increase the coverage area of the microcell. Increased coverage area could be achieved by installing a more powerful radio frequency amplifier. However, the size of the box containing the microcell is too small to accommodate the more powerful amplifier and dissipate the additional heat generated thereby.

The increased coverage area could also be achieved by radiating from a taller tower, but if the cell site is at the base of the tower, significant losses occur in the cabling between the cell site and the antennas. In any event, in the microcell the antenna may be integrated with the electronics in the same box. Accordingly, it would be advantageous to locate the microcell at the top of the tower, since changing the elevation of the microcell from twenty feet to one hundred feet would increase the coverage area by a factor of about four. However, active electronics on the top of a tower need maintenance, so that the electronics either has to be lowered to a technician or the technician has to be able to raise and lower the electronics. This has been done in the past by using a cable and a winch with pulleys at the top of the tower.

In the event that the hoist cable breaks or otherwise fails to hold the microcell, the microcell will go into a free fall condition. Accordingly, it would be desirable to provide a safety device for stopping the fall of a microcell under such conditions.

SUMMARY OF THE INVENTION

For cost reasons, the tower of choice would be a guyed latticework tower. One standard such tower is a triangular latticework structure measuring approximately three feet along each side. This structure is just large enough to fit a microcell within the confines of the tower. The advantages of putting the microcell within the tower are:

- If the microcell were to fall, it would be confined within the tower.
- The center of gravity of the microcell can be located very near the center of the tower, reducing distortions on the tower.
- The "superstructure" for supporting the winch and pulley arrangement that lifts and lowers the microcell can be supported across members of the tower, rather than cantilevered off the edge, resulting in a less expensive installation.
- The microcell can be constrained from "wobbling" as it moves up and down the tower by means of guides that are positioned against the ribs of the tower. If the microcell were supported external to the tower, added hardware would be needed to keep the microcell stable, thereby increasing the cost of the installation.

According to the present invention, there is provided a safety device for a platform cable hoist for a platform within a latticework tower. The tower includes at least three vertically oriented members and a plurality of transverse braces interconnecting adjacent vertically oriented members. The hoist includes a lift cable having a first end adapted to be secured to the platform and a second end coupled to a winch. The safety device comprises a plurality of vertically oriented skid members secured to the platform. Each of the skid members is positioned between a respective adjacent pair of vertically oriented tower members and has a generally planar surface adapted to slidingly contact the transverse braces interconnecting the respective adjacent pair of vertically oriented members as the platform is raised and lowered. Each of the skid members has an upper portion extending above the platform. A plurality of cable connection members are each secured to a respective skid member upper portion and a plurality of connector cables are each secured at a first end to a respective cable connection member and at a second end to the lift cable. A plurality of brake members are each attached to a respective skid member upper portion between the platform and the respective cable connection member. Each of the brake members includes a hook portion extending outwardly and downwardly. The hook portion is sized to fit over a transverse brace of the tower. Each brake member also includes an energy absorbing portion coupling the hook portion to the respective skid member upper portion. Accordingly, when tension is applied by the lift cable through the connector cable, the skid member upper portions are flexed inwardly so that the brake member hook portions clear the transverse braces of the tower during movement of the platform. When tension is released, as by a cable break, the skid member upper portions move outwardly so that the brake member hook portions engage respective transverse braces as the platform falls, with the brake member energy absorbing portions gradually slowing the rate of descent of the platform until it comes to a halt.

In accordance with an aspect of this invention, each of the brake members is formed unitarily from a planar sheet of metal with the energy absorbing portion being formed with corrugations extending generally horizontally. Accordingly, when a brake member hook portion engages a transverse brace as the platform falls, flattening of the corrugations occurs to absorb the kinetic energy of the falling platform.

In accordance with another aspect of this invention, each of the brake members comprises a generally rectilinear sheet having one end formed as the hook portion and a region between the hook portion and the end opposite the one end being formed as the energy absorbing portion. That region has a plurality of apertures arrayed along a substantially vertical line. Each of the brake members also comprises a pin member secured to the respective skid member upper portion. The pin member extends through the aperture closest to the one end. Accordingly, when a brake member hook portion engages a transverse brace as the platform falls, the respective skid member moves downwardly relative to the sheet and the pin member applies a load to the material of the sheet between the aperture through which it extends and the next lower aperture, thereby deforming the material. If the applied load is sufficient, the material is sheared. This process absorbs the kinetic energy of the falling platform and continues down the sheet from aperture to aperture to slow the falling platform.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
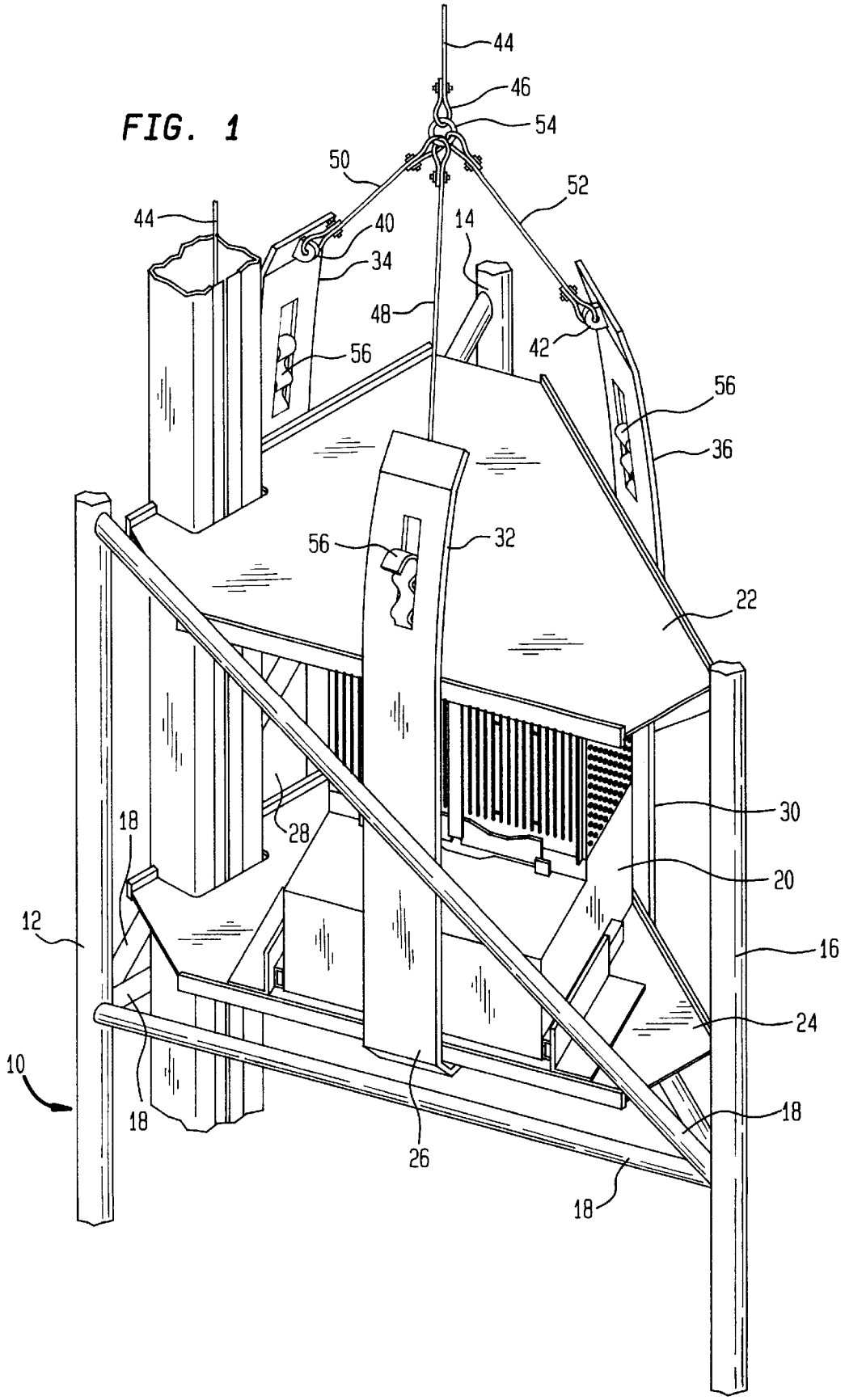
FIG. 1 is a perspective view showing a portion of a latticework tower having a cable hoist for a platform and including a safety device constructed in accordance with a first embodiment of this invention.
Figure 2:
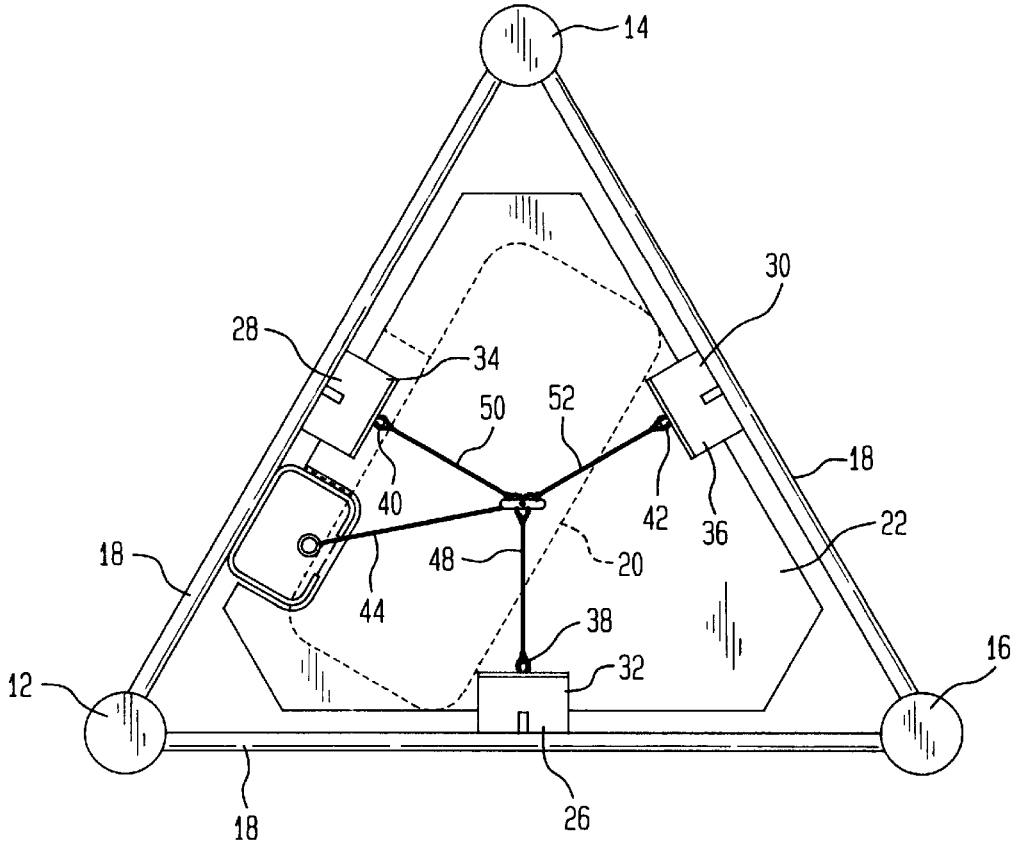
FIG. 2 is a top plan view showing the cable hoist and tower of FIG. 1.
Figure 3:
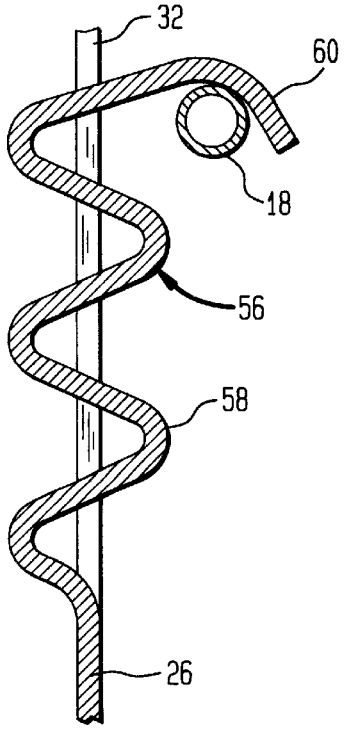
FIG. 3 is an enlarged side view, partially in cross section, showing a first embodiment of a brake member according to the present invention.

Referring now to the drawings, FIG. 1 shows a portion of a tower, designated generally by the reference numeral 10, in which is installed a safety device for a cable hoist constructed according to the present invention. Illustratively, the tower 10 is a three-sided latticework tower having three vertically oriented members 12, 14, 16 which are interconnected by a plurality of transverse braces 18. Although the tower 10 is shown as being triangular, other multi-sided towers or a circular tower can be utilized when practicing the present invention. In all cases, the transverse braces would interconnect adjacent vertically oriented members of the tower, so that the interior of the tower is open.

The microcell 20 is secured between a top plate 22 and a bottom plate 24, together making up a generally polygonal platform which is raised and lowered. The vertices of the plates 22, 24 are each adjacent a respective one of the vertically oriented members 12, 14, 16. Secured to the plates 22, 24, as by welding or the like, are a plurality of skid members 26, 28, 30. Each of the skid members 26, 28, 30 is vertically oriented and is positioned between a respective adjacent pair of vertically oriented tower members 12, 14, 16. Each of the skid members 26, 28, 30 has a generally planar outwardly facing surface adapted to slidingly contact the braces 18 as the platform is raised and lowered. Further, each of the skid members 26, 28, 30 has a respective upper portion 32, 34, 36 extending above the top plate 22. Near the top of each upper portion 32, 34, 36, is secured a respective cable connection member 38, 40, 42, illustratively an eyelet plate.

The platform including the microcell 20 is adapted to be raised and lowered along the tower 10 by a cable hoist including a lift cable 44 having a first end 46 secured to the platform and a second end coupled to a motor (not shown). Secured to the first end 46 of the cable 44 are a plurality of connector cables 48, 50, 52. Each of the connector cables 48, 50, 52 has its first end secured to a respective one of the cable connection members 38, 40, 42 and its second end to the first end 46 of the cable 44, illustratively by means of the ring 54.

The present invention provides a "brake" for the microcell platform in the event that the cable 44 breaks or otherwise fails to hold the platform. Specifically, a plurality of brake members are each attached to a respective skid member upper portion 32, 34, 36 between the platform and the respective cable connection member 38, 40, 42. Each brake member includes a hook portion extending outwardly and downwardly and sized to fit over a transverse brace 18 of the tower 10, and an energy absorbing portion coupling the hook portion to the respective skid member upper portion.

In a first embodiment of the present invention, as shown in FIGS. 1–4, each of the brake members 56 is formed unitarily from a planar sheet of metal with the energy absorbing portion 58 being formed with corrugations extending generally horizontally and with the hook portion 60 extending outwardly from the skid member upper portion 32. Each of the skid member upper portions is a generally planar sheet of metal and, according to the first embodiment, each of the brake members 56 is formed from an elongated three-sided rectilinear segment cut from the respective skid member upper portion sheet, with the uncut fourth side of the segment attaching each brake member to its respective skid member upper portion.

Figure 4:
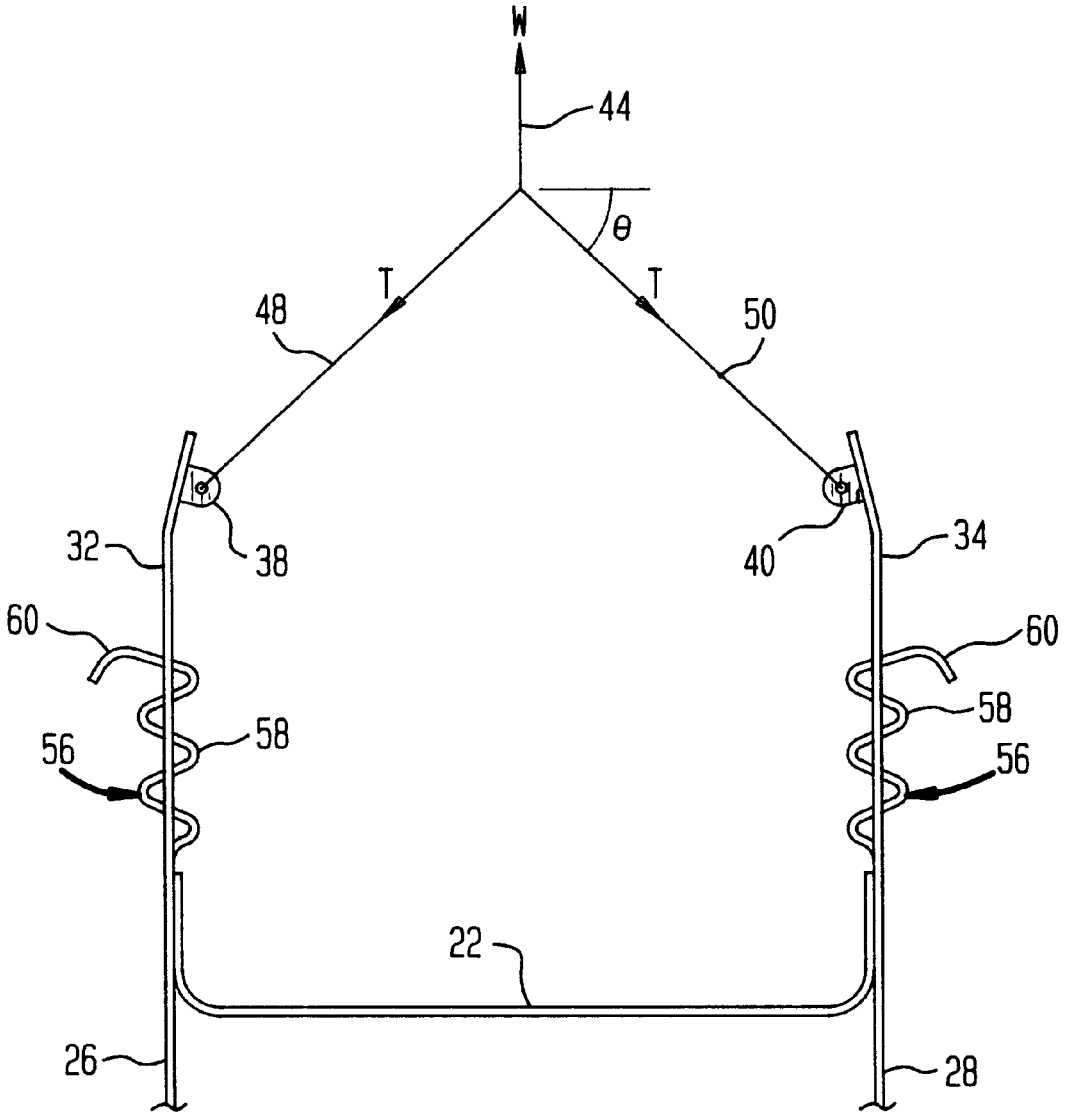
FIG. 4 is a force diagram useful in understanding the present invention.

FIG. 4 shows two of the skid members 26, 28 secured to the cable 44. For clarity, only two of the skid members have been illustrated. As the cable 44 lifts the microcell platform, the upper portions 32, 34 of the skid members 26, 28 flex inwardly, so that the hook portions 60 of the brake members 56 clear the transverse braces 18 of the tower 10. The weight (W) of the microcell platform is balanced by the tension (T) on the cables 48, 50, 52 to the skid members 26, 28, 30. Thus, $W=3\ T \sin \theta$. Simple trigometric relations yield the horizontal component of the tension ($T_x$) to be $T_x=W/3 \tan \theta$. Thus, the horizontal component of the tension increases to infinity as the angle $\theta$ approaches 0°. Accordingly, by changing the angle $\theta$, any desired force to flex the skid member upper portions 32, 34, 36 can be obtained.

In the event of failure of the cable 44, the cable tension is lost and the skid member upper portions 32, 34, 36 spring back to the vertical, unflexed, position. Then, as the microcell platform falls downwardly, the hook portions 60 engage the nearest transverse braces 18 on the tower 10. As the microcell platform continues to fall, its kinetic energy is absorbed by the energy required to flatten the corrugations 58.

The design parameters must be carefully balanced for this design to be effective. The length and cross section of the skid members 26, 28, 30 must be stiff enough to resist flexing too easily, must be flexible enough to bend clear of the braces 18 when loaded with the weight of the microcell platform, and must stay springy under load (i.e., must not undergo plastic deformation). Also, the angle of the connector cables 48, 50, 52 must be carefully controlled. If the connector cables 48, 50, 52 form too shallow an angle, the horizontal loads can get very high, even for a modest lifting load. At the other extreme, if the connector cables 48, 50, 52 are almost vertical, there will be insufficient horizontal loads to deflect the skid member upper portions 32, 34, 36.

Figure 5:
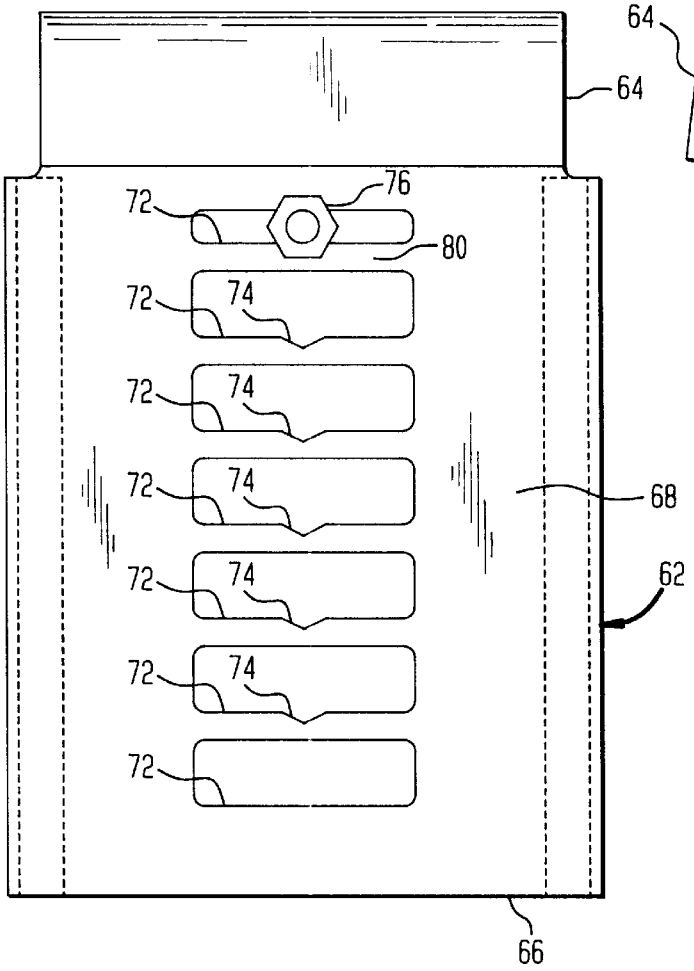
FIG. 5 is an elevational view showing a second embodiment of a brake member according to the present invention.
Figure 6:
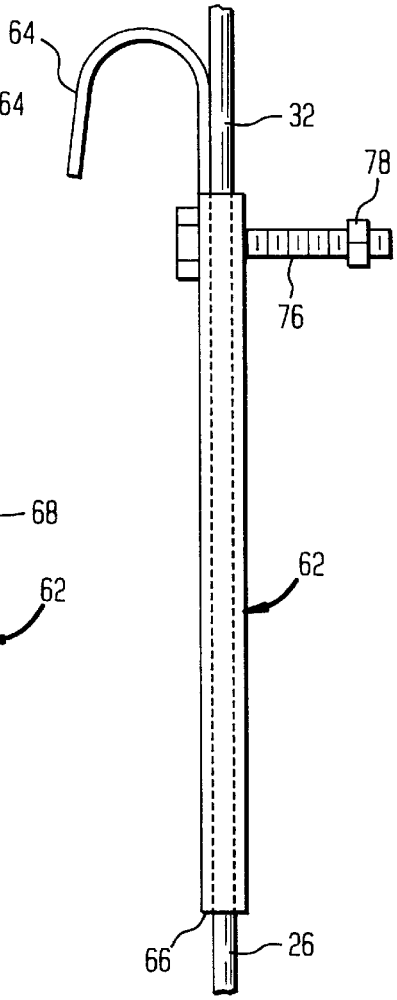
FIG. 6 is a side view of the brake member shown in FIG. 5, illustrating how the brake member is secured to a skid member.
Figure 7:
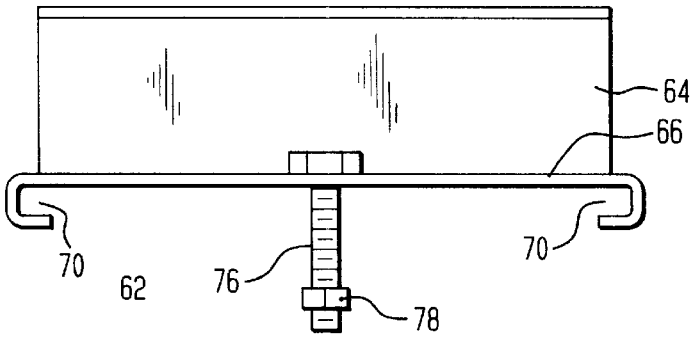
FIG. 7 is a bottom plan view of the brake member shown in FIG. 5.

FIGS. 5–7 illustrate a second embodiment of a brake member 62 according to this invention. In this embodiment, the brake member 62 is formed from a generally rectilinear sheet separately from each skid member. One end of the sheet is formed into the hook portion 64 of the brake member 62 and the region between the hook portion 64 and the opposite end 66 is formed as the energy absorbing portion 68. The lateral edges of the brake member 62 adjacent the energy absorbing portion 68 are folded back away from the hook portion 64 to form opposed channels 70 for receiving the respective skid member upper portion.

The energy absorbing portion 68 is formed with a plurality of apertures 72 arrayed along a substantially vertical line. Each of the apertures is substantially rectangular and has a notch 74 located substantially centrally within the aperture 72 and extending toward the next lower aperture 72. All of the notches 74 lie along the substantially vertical line. A pin member 76, illustratively a headed bolt, extends through the aperture 72 which is closest to the hook portion 64 and is secured to the skid member upper portion 32, as by the nut 78.

In the event of failure of the cable 44, if the microcell platform falls, the hook portion 64 engages a transverse brace 18 to stop the motion of the brake member 62. However, the microcell platform continues to descend and, as the skid member 26 continues to descend, the bolt 64 applies a large load to the crumple region 80 between the uppermost aperture 72 and the next lower aperture. This causes the crumple region 80 to deform. If the load is sufficient, the load is concentrated by the notch 74 and the crumple region 80 shears, dropping the bolt into the next lower aperture 72. The deformation and shearing of the crumple region 80 absorbs kinetic energy from the falling microcell platform, thereby slowing its fall. The aforedescribed process continues until all of the kinetic energy of the falling microcell platform is absorbed.

In an experiment, the brake member 62 was formed from a 0.090" thick sheet of aluminum. Each of the apertures 72 was 2" wide and 0.60" high and each crumple zone 80 was 0.267" high. In the experiment, a cart filled with one hundred pounds of concrete was put on a ramp that allowed the equivalent of a twenty inch vertical drop. During the experiment, four crumple regions 80 sheared, a fifth crumple region 80 was deformed but not broken, and a sixth crumple region 80 was untouched.

Figure 8:
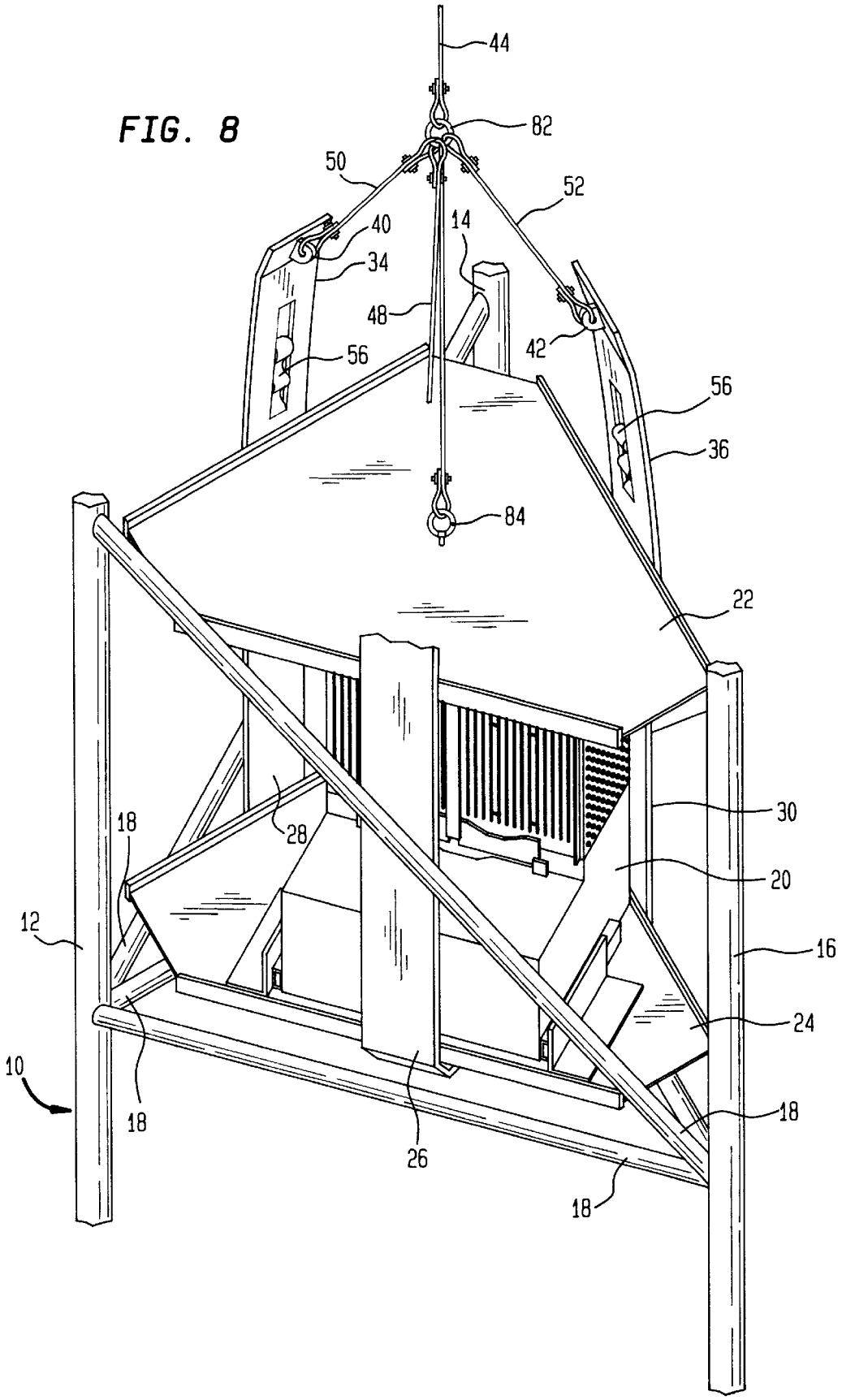
FIG. 8 is a partial perspective view showing a modification of the connection of the lift cable to the platform which is suitable for a heavier than normal platform.

As previously described, the dimensional parameters of the safety device must be selected carefully. For example, if the platform and microcell weigh several hundred pounds, the skid member upper portions 32, 34, 36 become very long in order to avoid plastic deformation for any reasonable skid cross section. To avoid this problem, as shown in FIG. 8, the lift cable 44 may be extended to fasten to the retainer 82 secured to the top plate 22. In this configuration, a further retainer 84 is rigidly fastened to a point on the cable 44 so that the three connector cables 48, 50 and 52 are geometrically positioned to provide the appropriate amount of deflection to the skid member upper portions 32, 34, 36. This configuration displaces most of the lifting load from the skid member upper portions 32, 34, 36 to the top plate 22. Thus, the dimensions of the skid member upper portions 32, 34, 36 can be selected based only on their need to deflect away from the tower transverse braces 18. Alternatively, a separate cable section could be provided between the ring 54 (FIG. 1) and the retainer 84.

Accordingly, there has been disclosed an improved safety device for a cable hoist. While illustrative embodiments of the present invention have been disclosed herein, it is understood that various modifications and adaptations to the disclosed embodiments are possible. Thus, while a triangular latticework tower has been described, it will be appreciated that, provided there are transverse braces which can be "hooked" by the inventive safety device, any shape tower can accommodate the inventive safety device. It is therefore intended that this invention be limited only by the scope of the appended claims.

What is claimed is:

1. A safety device in combination with a cable hoist including a platform within a latticework tower, wherein the tower includes at least three vertically oriented members and a plurality of transverse braces interconnecting adjacent vertically oriented members, and wherein the hoist includes a lift cable having a first end adapted to be secured to the platform and a second end coupled to a winch, the safety device comprising:

a plurality of vertically oriented skid members secured to the platform, each of the skid members being positioned between a respective adjacent pair of vertically oriented tower members and having a generally planar surface adapted to slidingly contact the transverse braces interconnecting said respective adjacent pair of vertically oriented members as the platform is raised and lowered, each of said skid members having an upper portion extending above said platform;

a plurality of cable connection members each secured to a respective skid member upper portion;

a plurality of connector cables each secured at a first end to a respective cable connection member and at a second end to said lift cable; and a plurality of brake members each attached to a respective skid member upper portion between said platform and the respective cable connection member, each of said brake members including:

a hook portion extending outwardly and downwardly, said hook portion being sized to fit over a transverse brace of said tower; and an energy absorbing portion coupling said hook portion to said respective skid member upper portion;

whereby, when tension is applied by the lift cable through the connector cables, the skid member upper portions are flexed inwardly so that the brake member hook portions clear the transverse braces of the tower during movement of the platform, and when tension is released, as by a cable break, the skid member upper portions move outwardly so that the brake member hook portions engage respective transverse braces as the platform falls, with the brake member energy absorbing portions gradually slowing the rate of descent of the platform until it comes to a halt.

2. The safety device according to claim 1 wherein each of said brake members is formed unitarily from a planar sheet of metal with said energy absorbing portion being formed with corrugations extending generally horizontally;

whereby, when a brake member hook portion engages a transverse brace as the platform falls, flattening of the corrugations occurs to absorb the kinetic energy of the falling platform.

3. The safety device according to claim 2 wherein each of said skid member upper portions is a generally planar sheet of metal and each of said brake members is formed from an elongated three-sided rectilinear segment cut from the respective skid member upper portion sheet, with the uncut fourth side of the segment attaching each brake member to its respective skid member upper portion.

4. The safety device according to claim 1 wherein each of said brake members comprises:

a generally rectilinear sheet having one end formed as said hook portion and a region between said hook portion and the end opposite said one end being formed as said energy absorbing portion, said region having a plurality of apertures arrayed along a substantially vertical line; and a pin member secured to the respective skid member upper portion and extending through the aperture closest to said one end;

whereby, when a brake member hook portion engages a transverse brace as the platform falls, the respective skid member moves downwardly relative to the sheet and the pin member applies a load to the material of the sheet between the aperture through which it extends and the next lower aperture, thereby deforming the material and, if the applied load is sufficient, shearing the material, this process absorbing kinetic energy of the falling platform and continues down the sheet from aperture to aperture to slow the falling platform.

5. The safety device according to claim 4 wherein each of said apertures is substantially rectangular with a notch extending toward the next lower aperture, the notches of all of said apertures lying along said substantially vertical line, and wherein said pin member extends through the notch in the aperture closest to said one end.

6. The safety device according to claim 4 wherein said pin member comprises a headed bolt.

7. The safety device according to claim 4 wherein the opposed lateral edges of said sheet between said hook portion and the end opposite said one end are folded back away from said hook portion to form opposed channels for receiving the respective skid member upper portion.

8. The safety device according to claim 1 further wherein each of said connector cables is secured at its second end to said first end of said lift cable, the safety device further comprising:

a cable retainer secured to said platform; and a cable section secured at a first end to said cable retainer and at a second end to said first end of said lift cable;

wherein the length of said cable section is selected to limit the inward deflection of said skid member upper portions to an amount sufficient that said brake member hook portions clear said tower transverse braces during platform movement.

* * * * *